US009845560B2

(12) United States Patent
Chang et al.

(10) Patent No.: US 9,845,560 B2
(45) Date of Patent: Dec. 19, 2017

(54) WASHING MACHINE WITH BUOYANCY CLUTCH AND CONTROLLING METHOD THEREOF

(75) Inventors: Jae Won Chang, Seoul (KR); Kyu Bum Lee, Seoul (KR); Young Jong Kim, Seoul (KR); Ae Kyung Chae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1079 days.

(21) Appl. No.: 13/997,111

(22) PCT Filed: Dec. 26, 2011

(86) PCT No.: PCT/KR2011/010085

§ 371 (c)(1),
(2), (4) Date: Nov. 26, 2013

(87) PCT Pub. No.: WO2012/091380

PCT Pub. Date: Jul. 5, 2012

(65) Prior Publication Data

US 2014/0182066 A1 Jul. 3, 2014

(30) Foreign Application Priority Data

Dec. 27, 2010 (KR) ..... 10-2010-0135854

(51) Int. Cl.
*D06F 37/40* (2006.01)
*D06F 23/04* (2006.01)
(Continued)

(52) U.S. Cl.
CPC ..... *D06F 23/04* (2013.01); *D06F 33/02* (2013.01); *D06F 37/40* (2013.01); *D06F 39/085* (2013.01); *D06F 2204/06* (2013.01)

(58) Field of Classification Search
CPC ..... D06F 37/40; D06F 39/085; D06F 33/02; D06F 23/04; D06F 2204/06
See application file for complete search history.

(56) References Cited

U.S. PATENT DOCUMENTS 4,837,882 A 6/1989 Brenner et al.
5,551,261 A 9/1996 Lyu et al.
(Continued)

FOREIGN PATENT DOCUMENTS

GB 2287960 A 10/1995
KR 10-2003-0049403 A 6/2003

*Primary Examiner* — Joseph L Perrin
*Assistant Examiner* — Irina Graf
(74) *Attorney, Agent, or Firm* — Dentons US LLP

(57) ABSTRACT

The washing machine includes an outer tub, an inner tub rotatably provided in the outer tub, a pulsator rotatably provided in the inner tub, a power transmission shaft rotating the pulsator, a buoyancy clutch that moves up and down by buoyancy created by wash water and transfers, when the buoyancy clutch is in a lower position, rotational force from the power transmission shaft to the inner tub to allow the pulsator and the inner tub to rotate integrally with each other, a circulation passage that is provided on an outer portion of the outer tub to allow the wash water drained out of the outer tub to be returned into the outer tub, a pump provided on the circulation passage and a drain guide unit that directs the wash water under the buoyancy clutch to a drain hole of the outer tub so that the buoyancy clutch moves downward.

13 Claims, 5 Drawing Sheets

(51) Int. Cl.
*D06F 33/02* (2006.01)
*D06F 39/08* (2006.01)

(56) References Cited

U.S. PATENT DOCUMENTS

| | | | | |
|---|---|---|---|---|
| 5,586,455 | A | 12/1996 | Imai et al. | |
| 5,651,277 | A | 7/1997 | Richardson | |
| 6,332,343 | B1 * | 12/2001 | Koketsu | D06F 37/304 68/12.02 |
| 2003/0051516 | A1 * | 3/2003 | Lee | D06F 37/40 68/23.6 |
| 2003/0074931 | A1 * | 4/2003 | Lee | D06F 37/40 68/23.7 |
| 2003/0110575 | A1 | 6/2003 | Lee et al. | |
| 2007/0101772 | A1 | 5/2007 | Duncan et al. | |
| 2007/0130999 | A1 | 6/2007 | Dominguez et al. | |
| 2010/0281926 | A1 * | 11/2010 | Seo | D06F 17/10 68/132 |

* cited by examiner

[Fig. 1]
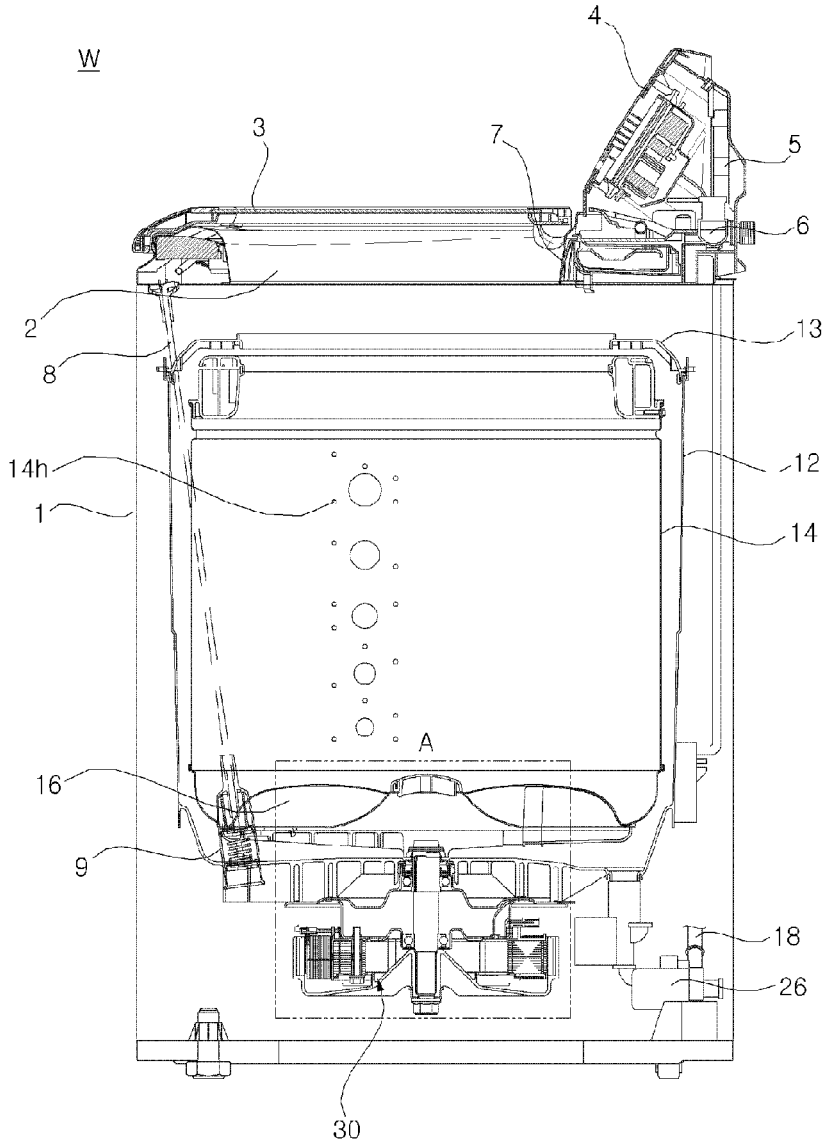

[Fig. 2]
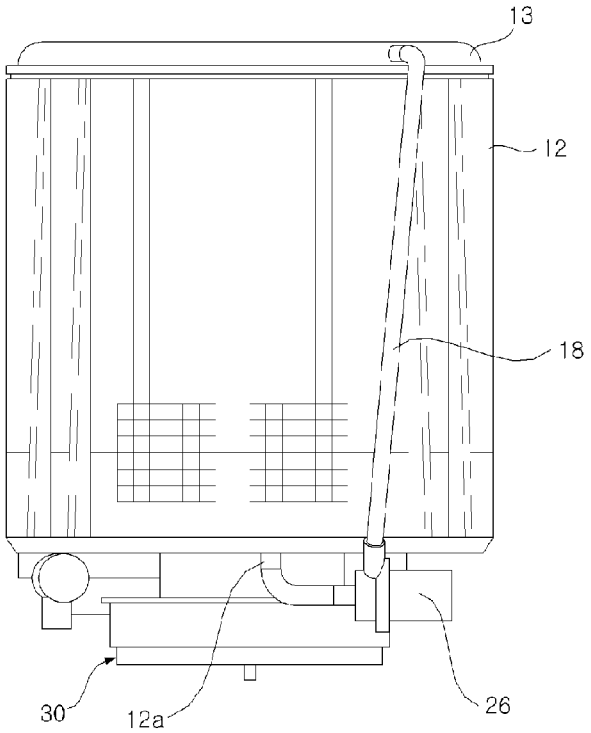
[Fig. 3a]
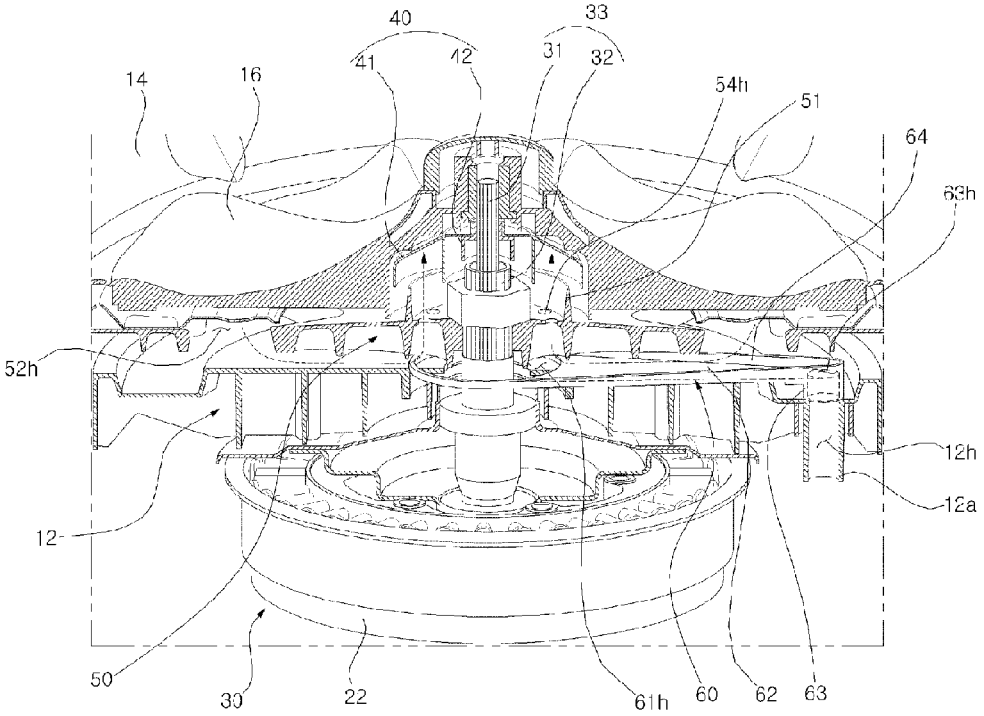

[Fig. 3b]
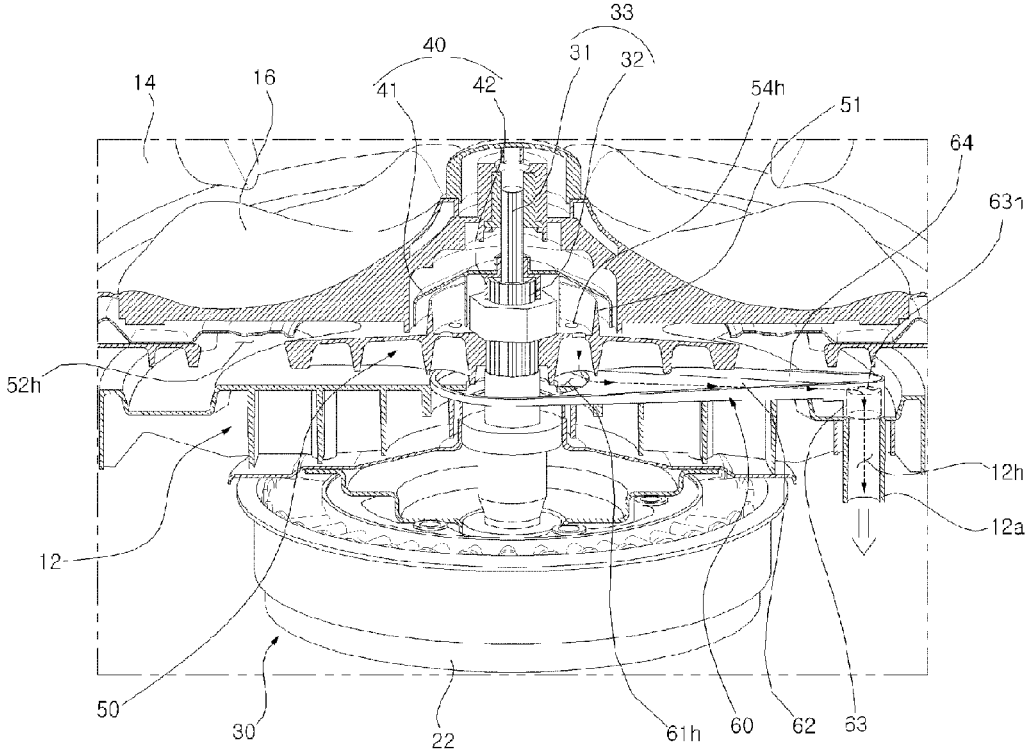
[Fig. 4]
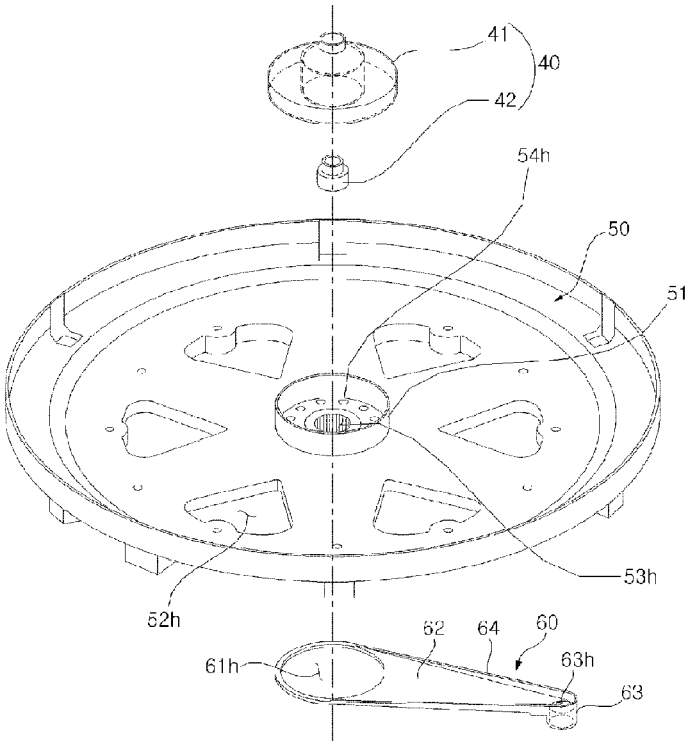

[Fig. 5a]
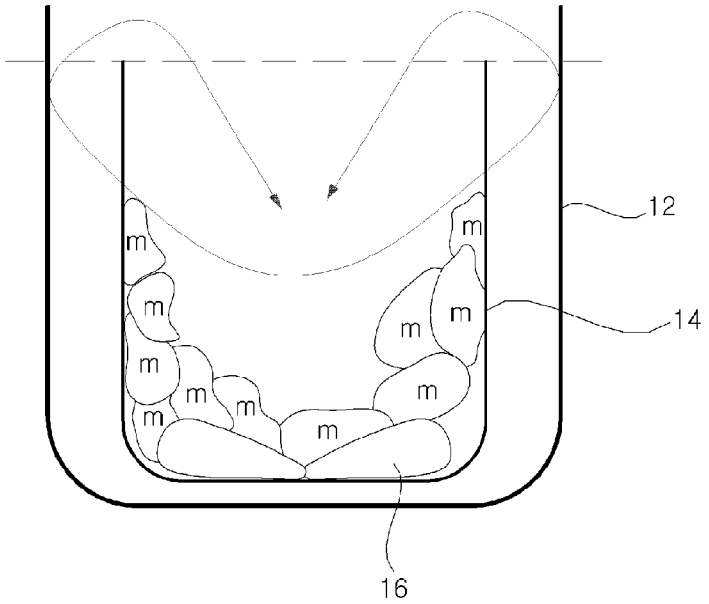
[Fig. 5b]
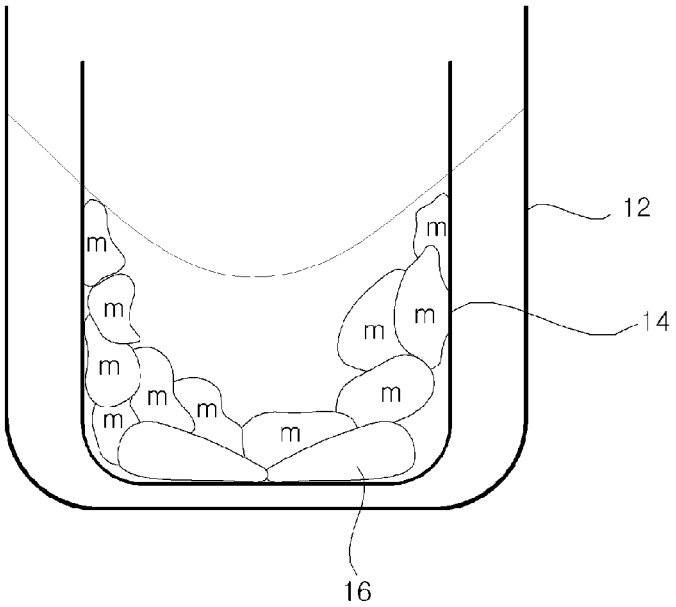

[Fig. 6]
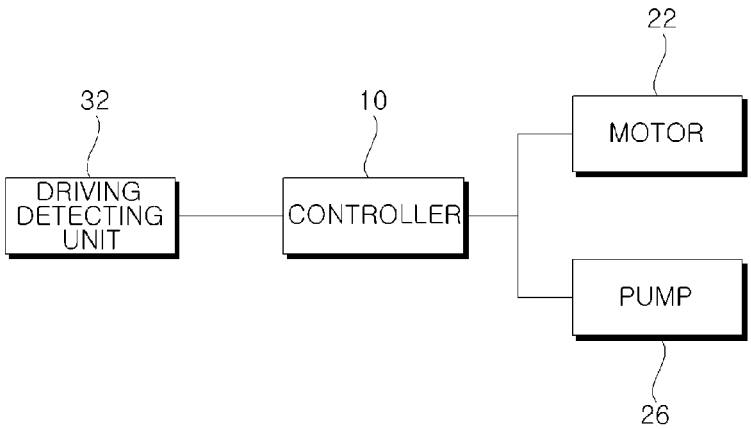
[Fig. 7]
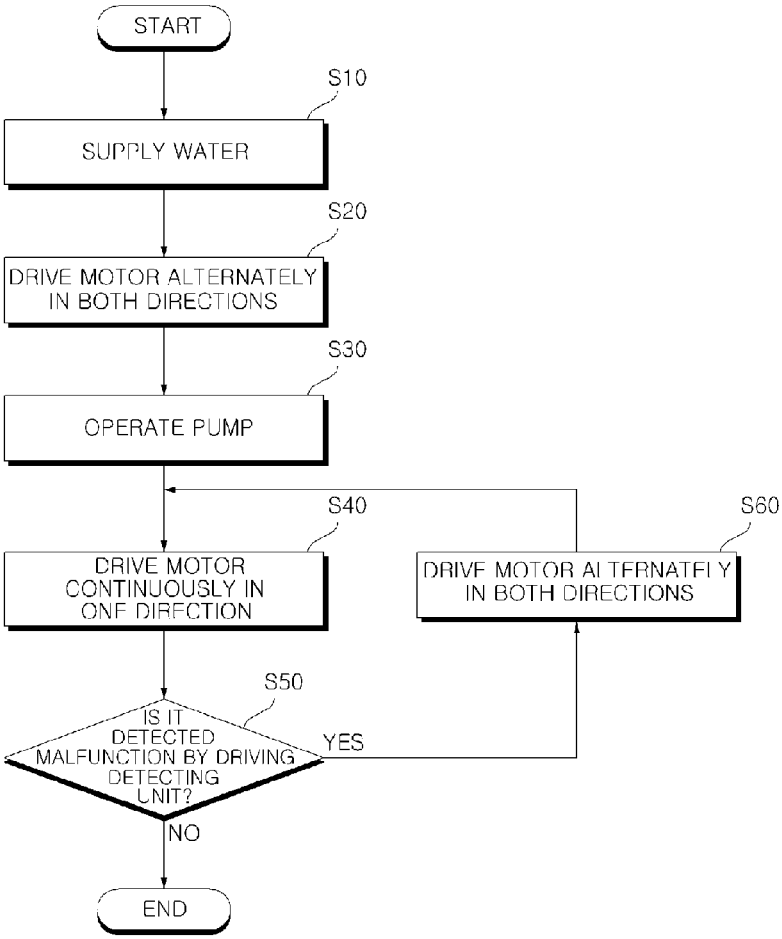

WASHING MACHINE WITH BUOYANCY CLUTCH AND CONTROLLING METHOD THEREOF

This application is a 35 USC §371 National Stage entry of International Application No. PCT/KR2011/010085 filed Dec. 26, 2011, and claims priority of Korean Application No. 10-2010-0135854 filed Dec. 27, 2010, which is hereby incorporated by reference in its entirety.

TECHNICAL FIELD

The present invention relates to a washing machine and, more particularly, to a washing machine having a buoyancy clutch that operates when wash water is filled in an inner tub and a method of controlling the washing machine.

BACKGROUND ART

A washing machine generally refers to various devices for processing the laundry by applying a physical and chemical action to the laundry, such as a laundry machine for detaching a contaminant from the clothes, bedclothes, and the like, (referred to as the 'laundry', hereinafter) by using a chemical decomposition operation between water and a detergent and a physical operation such as friction between water and the laundry.

The related art washing machine includes a pulsator that is rotatably provided in an inner tub in which laundry is loaded. The inner tub and/or pulsator rotate by a motor. Here, rotational force generated by the motor is selectively transferred to the inner tub and/or pulsator by a clutch.

The clutch moves up and down by buoyancy created by the wash water. When the clutch is in an upper position, a driving shaft of the motor is engaged with the pulsator to rotate only the pulsator. When the clutch is in a lower position, the driving shaft of the motor is engaged with both the pulsator and inner tub to rotate the pulsator and inner tub together.

However, the clutch that operates by the buoyancy has a problem in that, since it is always in the upper position when the wash water is filled in the inner tub, it cannot rotate the inner tub when the wash water is filled in the inner tub. When the wash water is filled in the inner tub, the prior art buoyancy clutch can rotate only the pulsator. That is, the clutch is engaged with not only the pulsator but also the inner tub only in a spin cycle that is performed after the wash water is drained out of the inner tub.

In addition, when the clutch is accurately shifted from the upper position to the lower position, the driving shaft of the motor cannot be accurately engaged with the inner tub. When the motor is driven with a high speed in this state, a shaft-engaging portion of the inner tub may be damaged. This results in the deterioration of the durability of the washing machine. Therefore, there is a need for a method for detecting if the clutch operates accurately and, when the clutch inaccurately operates, correcting the inaccurate operation of the clutch.

DISCLOSURE OF INVENTION

Technical Problem

Thus, an object of the present invention is to provide a washing machine that is designed to rotate an inner tub by operating a buoyancy clutch even when wash water is filled in the inner tub.

Another object of the present invention is to provide a washing machine that is designed to remove buoyancy acting on a buoyancy clutch even when wash water is filled in the inner tub.

Still another object of the present invention is to provide a method of controlling a washing machine, which can improve operational accuracy of a buoyancy clutch.

The foregoing and other objects, features, aspects and advantages of the present invention will become more apparent from the following detailed description of the present invention when taken in conjunction with the accompanying drawings.

Solution to Problem

According to an aspect of the present invention, there is provided a washing machine including: an outer tub holding wash water; an inner tub rotatably provided in the outer tub and receiving laundry; a pulsator rotatably provided in the inner tub; a power transmission shaft including a first driving shaft rotating the pulsator and a second driving shaft engaged with the inner tub; a buoyancy clutch that is disposed between the pulsator and the outer tub, integrally rotate with the first driving shaft, moves up and down in accordance with buoyancy created by the wash water, is separated from the second driving shaft in an upper position, and is engaged with the second driving shaft in a lower position to allow the pulsator to rotate together with the inner tub; a circulation passage allowing the wash water drained out of the outer tub to be returned into the outer tub; a pump provided on the circulation passage; a hub that is disposed between the buoyancy clutch and the outer tub, coupled to the second driving shaft to support the inner tub, disposed under the buoyancy clutch, and provided with a plurality of through holes; and a passage guide that is disposed between the hub and the outer tub to direct the wash water drained through the through holes formed on the hub to a drain hole of the outer tub, the drain hole being connected to the circulation passage.

According to another aspect of the present invention, there is provided a washing machine including: an outer tub holding wash water; an inner tub rotatably provided in the outer tub and receiving laundry; a pulsator rotatably provided in the inner tub; a power transmission shaft rotating the pulsator; a buoyancy clutch that that moves up and down by buoyancy created by the wash water and transfers, when the buoyancy clutch is in a lower position, rotational force from the power transmission shaft to the inner tub to allow the pulsator and the inner tub to rotate integrally with each other; a circulation passage that is provided on an outer portion of the outer tub to allow the wash water drained out of the outer tub to be returned into the outer tub; a pump provided on the circulation passage and a drain guide unit that directs the wash water under the buoyancy clutch to a drain hole of the outer tub so that the buoyancy clutch moves downward.

According to another aspect of the present invention, there is provided a method of controlling a washing machine including an inner tub, an outer tub, a motor, a first driving shaft rotating by the motor, a second driving shaft, and a buoyancy clutch that integrally rotates with the first driving shaft, moves up and down along the first driving shaft by buoyancy creased by the wash water, and is engaged with the second driving shaft in a lower position of the buoyancy clutch to rotate the inner tub, the method including: alternately rotating the motor in both direction in a state where the wash water is filled in the inner tub; stopping the motor and operating the pump provided on the circulation passage; continuously driving the motor in one direction during the operation of the pump; and alternately rotating the motor in the both direction on the basis of a detection value of a driving detecting unit for detecting a driving state of the motor.

Advantageous Effects of Invention

According to the aspects, even when the wash water is filled in the inner tub, the buoyancy clutch can operate to rotate the inner tub.

Since the buoyancy clutch is provided in the outer tub, the space between the cabinet and the outer tub can be increased as compared with the prior art washing machine in which a clutch unit is provided at an outer side of the outer tub, thereby increasing the volume of the outer tub.

Since both the driving for rotating only the pulsator and the driving for integrally rotating the pulsator and the inner tub can be performed in the rinse and wash cycles, the washing pattern can be variously realized.

In addition, the operating accuracy of the buoyancy clutch can be improved.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a schematic view of a washing machine according to an exemplary embodiment of the present invention;

FIG. 2 is a schematic view of a circulation passage and a pump of the washing machine of FIG. 1;

FIGS. 3*a* and 3*b* are enlarged views of a portion A of FIG. 1, in which FIG. 3*a* illustrates a state where a buoyancy clutch is in an upper position and FIG. 3*b* illustrates a state where the buoyancy clutch is in a lower position;

FIG. 4 is an exploded perspective view illustrating a buoyancy clutch, a hub, and a passage guide that are illustrated in FIGS. 3*a* and 3*b;*

FIG. 5*a* is a schematic view illustrating a centrifugal circulation water stream;

FIG. 5*b* is a schematic view illustrating a pressurized water stream;

FIG. 6 is a block diagram illustrating a control relationship between major parts of the washing machine according to an exemplary embodiment of the present invention; and FIG. 7 is a flowchart of a washing machine control method according to an exemplary embodiment of the present invention.

BEST MODE FOR CARRYING OUT THE INVENTION

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

FIG. 1 is a schematic view of a washing machine according to an exemplary embodiment of the present invention and FIG. 2 is a schematic view of a circulation passage and a pump of the washing machine of FIG. 1.

Referring to FIG. 1, a washing machine W according to an exemplary embodiment of the present invention includes a cabinet 1, a top cover 2 disposed on a top of the cabinet 1 and provided with a laundry loading hole through which the laundry is loaded and unloaded, a door 3 that is coupled to the top cover 2 to open and close the laundry loading hole, and a control panel 4 providing a user interface for allowing a user to input a variety of control commands and displaying operational information of the washing machine W.

An outer tub 12 is suspended in the cabinet 1 by a supporting member 8. The supporting member 8 is connected to the outer tub 12 by a suspension 9 to attenuate vibration generated during washing. An inner tub 14 is rotatably disposed in the outer tub 12.

The water is supplied from an external water source into the outer and inner tubs 12 and 14 through a water supply passage 5 via a washing aid box 7. Various washing aid agents such as detergent, softener, whitener, and/or the like are stored in the washing aid box 7. The washing aid agents are mixed with the water and supplied into the outer and inner tubs 12 and 14. Therefore, hereinafter, "wash water" may be defined as any one of water and water mixed with the washing aid agents.

An outer tub cover 13 is provided on a top of the outer tub 12. The outer tub cover 13 is formed in a ring-shape having a central opening through which the laundry is loaded and unloaded. The outer tub over 13 prevents the wash water from scattering into the outer tub 12 and guides the wash water, which ascends along a space between the outer and inner tubs 12 and 14 when centrifugal circulation water stream is formed, to be poured into the inner tub 14 along a rear surface of the outer tub cover 13.

The wash water flows into the space defined between the outer and inner tubs 12 and 14 through a plurality of through holes 14*h* formed through the inner tub 14.

A pulsator 16 is rotatably provided on a lower portion of the inner tub 14. Dirt is removed from the laundry by mechanical force that is created by the rotation of the pulsator 16 and acts on the laundry.

A driving unit 30 may be classified into a direct driving type and an indirect driving type in accordance with a method for transferring the rotational force of the motor 22 to the pulsator 16 and the inner tub 14. In this exemplary embodiment, the direct driving type in which the rotational shaft of the motor is coaxially engaged with the inner tub and the pulsator. However, the present invention is not limited to this type. The indirect driving type in which the rotational force is transferred through a power transmission unit such as a belt or pulley may be also possible.

The washing machine further includes a pump 26. The pump 26 is designed to drain the wash water out of the outer tub 12. In this exemplary embodiment, the pump 26 is described as a circulation/drain pump that circulates the wash water drained from the outer tub 12 through the circulation passage 18 or drains the wash water out of the washing machine W. However, the present invention is not limited to this. For example, a drain pump for draining the wash water drained from the outer tub 12 out of the washing machine W and a circulation pump for circulating the wash water drained from the outer tub 12 through the circulation passage 18 are provided.

The pump 26 may drain the wash water drained from the outer tub 12 out of the washing machine W through a drain passage (not shown) by proper passage change. However, in this exemplary embodiment, only a function where the wash water drained from the outer tub 12 is pumped by the pump 26 and returned to the outer tub 12 through the circulation passage 18 will be described.

In the washing machine of this exemplary embodiment, it is enough that the circulation passage is designed to guide the wash water drained from the outer tub 12 to be returned to the outer tub 12. This may be realized through a variety of ways. FIG. 2 illustrates the circulation passage according to an exemplary embodiment of the present invention. Here, the circulation passage 18 has a first end connected to a drain pipe 12*a* formed on a bottom of the outer tub 12 and extending upward through a space defined between the cabinet 1 and the outer tub 12 and a second end connected to the outer tub cover 13. The pump 26 is provided on the circulation passage 26 to pump the wash water.

When the pump 26 operates, the wash water in the outer tub 12 is drained to the circulation passage 18 through the drain pipe 12*a* and directed toward the outer cover 13 along the circulation passage 18, after which the wash water is sprayed into the outer tub 12 or the inner tub 14. Here, a nozzle (not shown) for spraying the wash water supplied through the circulation passage 18 toward the laundry loaded in the inner tub 14 may be provided on the outer tub cover 13.

FIGS. 3*a* and 3*b* are enlarged views of a portion A of FIG. 1, in which FIG. 3*a* illustrates a state where a buoyancy clutch is in an upper position and FIG. 3*b* illustrates a state where the buoyancy clutch is in a lower position. FIG. 4 is an exploded perspective view illustrating a buoyancy clutch, a hub, and a passage guide that are illustrated in FIGS. 3*a* and 3*b*.

As shown in FIGS. 3*a*, 3*b*, and 4, the driving unit 30 of the washing machine W includes a motor 22 and a power transmission shaft 33.

The power transmission shaft 33 transfers the rotation force created by the motor 22 to the pulsator 16 and/or the inner tub 14. The power transmission shaft 33 includes a first driving shaft 31 rotating the pulsator 16 and a second driving shaft 32 rotating the inner tub 14.

The first and second driving shafts 31 and 32 are coaxially arranged and have different diameters. In this exemplary embodiment, the second driving shaft is a hollow shaft having an inner diameter greater than an outer diameter of the first driving shaft 31 so that the first driving shaft 31 is inserted in the second driving shaft 32.

The first driving shaft 31 is coupled to the pulsator 16 to integrally rotate with the pulsator 16.

Meanwhile, the inner tub 14 is supported by a hub 50 that is coupled to the second driving shaft 32. The second driving shaft 32 passes through a coupling hole 53*h* formed through the hub 50. A serration is formed on an outer circumference of the second driving shaft 32. A serration that is engaged with the serration formed on the second driving shaft 32 is formed on an inner circumference of the coupling hole 53*h* of the hub 50. Therefore, when the second driving shaft 32 rotates, the hub 50 rotates together with the second driving shaft 32.

As shown in FIGS. 3*a* and 3*b*, the hub 50 is disposed between the pulsator 16 and the outer tub 12. The hub 50 is provided with a plurality of holes 52*h* formed along a line extending in a circumferential direction so that the wash water in the inner tub 14 can be directed into the outer tub 12.

A buoyancy clutch 40 is inserted into the power transmission shaft 33 and disposed between the pulsator 16 and the hub 50. The buoyancy clutch 40 moves up and down by buoyancy created by the wash water. When the wash water is supplied to a space under the buoyancy clutch 40, the buoyancy clutch 40 moves upward by the buoyancy created by the wash water. When the wash water under the buoyancy clutch 40 is drained, the buoyancy is removed and thus the buoyancy clutch 40 moves downward.

In more detail, the hub 50 is provided with a barrier 51 that is formed along the circumference of the coupling hole 53*h* through which the power transmission shaft 33 passes. The buoyancy clutch 40 is disposed to enclose the barrier 51 and moves upward by the buoyancy creased by the wash water introduced into the barrier 51.

Meanwhile, the hub 50 is provided with a through hole 54*h* that is formed through an portion surrounded by the barrier 51. A plurality of the through holes 54*h* may be formed along the circumference of the coupling hole 53*h*. When the wash water is introduced into the buoyancy clutch 40 through the through hole 54*h*, the buoyancy clutch 40 moves upward. On the other hand, when the wash water is drained to the outer tub 12 through the through hole 54*h*, the buoyancy acting on the buoyancy clutch 40 is released and thus the buoyancy clutch 40 moves downward.

The buoyancy clutch 40 includes a floater 41 that moves up and down along the power transmission shaft 33 by the buoyancy created by the wash water and a second driving shaft engaging portion 42 that is engaged with the second driving shaft 32 when the buoyancy clutch is in a lower position. In this exemplary embodiment, although the floater 41 and the second driving shaft engaging portion 42 are provided as separated parts, they may be integrally formed with each other.

Meanwhile, the washing machine W further includes a drain guide portion that directs the wash water under the buoyancy clutch 40 toward the drain hole 12*h* formed on the outer tub 12 such that the buoyancy clutch 40 moves downward.

The drain guide portion, when the pump 26 operates, generates a relatively stronger water stream from the portion under the buoyancy clutch 40 toward the outer tub 12 so that the wash water under the buoyancy clutch 40 can be quickly drained toward the circulation passage 18. To this end, the drain guide portion forms a passage extending from a portion under the buoyancy clutch 40 toward the drain hole 12*h* of the outer tub 12.

The drain guide portion includes a plurality of through holes 54*h* formed on the hub 50 and a passage guide 60 for directing the wash water drained through the through holes 54 toward the drain hole 12*h*.

The passage guide 60 is formed between the outer tub 12 and the hub 50. The passage guide 60 is for directing the wash water drained to the outer tub 12 through the through holes 54*h* formed on the hub 50 toward the drain pipe 12*a* formed on the outer tub 12. The passage guide 60 is provided at a first end with an opening 61*h* through which the power transmission shaft 33 passes and at a second end with a drain pipe connecting portion 63 connected to the drain pipe 12*a* formed on the outer tub 12.

An inner diameter of the opening 61*h* of the passage guide 60 is greater than an outer diameter of the power transmission shaft 33. Accordingly, the inner circumference of the opening 61*h* is spaced apart from the power transmission shaft 33, thereby preventing the power transmission shaft 33 from interfering with the passage guide 60 when the power transmission shaft 33 rotates.

The passage guide 60 is provided with a guide surface 62 extending from the opening 61*h* to the drain pipe connecting portion 63 and a rib 64 extends along an edge of the guide surface 62. The drain pipe connecting portion 63 protrudes downward from a circumference of the drain hole 63*h* formed on the guide surface 62. A width of the passage on the guide surface 62 is gradually reduced from the opening 61*h* toward the drain pipe connecting portion 63. Accordingly, when the pump 26 operates, a water pressure gradient is formed between the opening 61*h* and the drain pipe connecting portion 63 and thus the tendency for directing the wash water from the opening 61*h* toward the drain pipe connecting portion 63 is intensified.

When the pump 26 operates, the wash water is drained from the outer tub 12 to the circulation passage 18 through the drain hole 12*h*. At this point, the water stream flowing toward the drain pipe connecting portion 63 along the guide surface 62 is intensified by suction created by the pump 26. Especially, since the rib 64 formed along the guide surface 62 further intensifies the flow of the washing water, the tendency where the washing water collected between the hub 50 and the buoyancy clutch 40 is drained to the outer tub 12 through the through hole 54*h* is intensified, the buoyancy clutch 40 may move downward even when the wash water is filled in the inner tub 14.

A mechanical operation for moving the buoyancy clutch 40 upward will be described in more detail with reference to FIG. 3*a*.

When the wash water is supplied, the water level of the outer tub 12 gradually increases and the water is directed into the space under the buoyancy clutch 40 through the through hole 54*h* of the hub 50. This flowing of the wash water is indicated by dotted-arrow in FIG. 3*a*. As the wash water is supplied under the buoyancy clutch 40, the buoyancy clutch 40 moves upward and thus the second driving shaft engaging portion 42 is separated from the second driving shaft 32. Accordingly, when the motor 22 is driven, only the pulsator 16 rotates.

A mechanical operation for shifting the buoyancy clutch 40 from the upper position to the lower position will be described in more detail with reference to FIG. 3*b*.

When the pump operates, the wash water collected under the buoyancy clutch 40 is drained to the outer tub 12 through the through hole 54*h* of the hub 50. The drained wash water is directed to the drain pipe 12*a* by the passage guide 60. At this point, the guide surface 62 of the passage guide 60 and the rib 64 intensify the water stream of the wash water that is drained through the through hole 54*h* of the hub 50 and is directed to the drain pipe connecting portion 63. Accordingly, the wash water between the buoyancy clutch 40 and the hub 50 is effectively drained to the outer tub 12 through the through hole 54*h* of the hub. This flowing of the wash water is indicated by dotted-arrow in FIG. 3*b*.

As the wash water collected under the buoyancy clutch 40 is drained to the outer tub 12, the buoyancy acting on the buoyancy clutch 40 is removed and thus the buoyancy clutch 40 moves downward. As a result, the second driving shaft engaging portion 42 is engaged with the second driving shaft 32. Therefore, the pulsator 16 and the inner tub 14 rotate together. Here, the second driving shaft engaging portion 42 is provided at an inner circumference thereof with a serration engaged with the serration of the second driving shaft 32.

Meanwhile, the wash water drained through the drain pipe 12*a* flows along the circulation passage 18 and is poured into the inner tub 14. Therefore, the inner tub 14 remains a state where the wash water is always filled in the same.

The washing machine W according to the exemplary embodiment of the present invention is designed, even when the wash water is filled in the inner tub 14 by forcedly lowering the buoyancy clutch 40 by operating the pump 26. Accordingly, in wash and rinse cycles that are preformed in a state where the wash water is filled in the inner tub 14, both a process for treating the laundry by rotating only the pulsator 16 and a process for treating the laundry by rotating both the pulsator 16 and the inner tub 14 together can be performed.

For example, in a state where the wash water is filled in the inner tub 14, the controller 10 alternately drives in both directions to rotate the pulsator 16, after which the controller 10 operates the pump 26 to drain the wash water collected under the buoyancy clutch 40 to the outer tub 12 so that the buoyancy clutch 40 is in the lower position, thereby rotating the pulsator 16 together with the inner tub 14. Here, describing the water streams formed during the rotation of the pulsator 16 and the inner tub 14, there are a centrifugal circulation water stream shown in FIG. 5*a* and a pressurized water stream shown in FIG. 5*b*.

Referring to FIG. 5*a*, the centrifugal circulation water stream is a stream in which the wash water between the outer and inner tubs 12 and 14 moves upward by the centrifugal force created by the rotation of the inner tub 14 and is poured into the inner tub 14. At this point, the laundry m is adhered to an inner wall of the inner tub 14 by the centrifugal force.

Referring to FIG. 5*b*, the pressurized water stream between the outer and inner tubs 12 and 14 is a stream in which the wash water moves upward by the centrifugal force created by the rotation of the inner tub 14 but does not flow over the inner tub. At this point, the laundry m is adhered to the inner wall of the inner tub 14.

By the centrifugal circulation water stream or the pressurized water stream, the wash water flows into the outer tub 12 through the through hole 14*h* and passes through the laundry m. Therefore, the laundry m can sufficiently absorb the washing aid agents. Particularly, by the centrifugal circulation water stream, a tap washing effect can be attained by the wash water poured into the inner tub 14.

FIG. 6 is a block diagram illustrating a control relationship between major parts of the washing machine according to an exemplary embodiment of the present invention. Referring to FIG. 6, the washing machine may further include a driving detecting unit 36.

The driving detecting unit 36 detects the driving state of the motor 22 through an RPM, a rotation cycle, or an output current variation of the motor 22.

The controller 10 determines if only the pulsator 16 rotates or the pulsator 16 rotates together with the inner tub 14 on the basis of the driving state of the motor 22 detected by the driving detecting unit 36.

For example, the driving detecting unit 36 may use a hall sensor. In this case, the driving detecting unit 36 may determine if only the pulsator 16 rotates or the pulsator 16 rotates together with the inner tub 14 on the basis of the rotation cycle of the motor 22, which is detected by the hall sensor.

Even if the driving of the motor is controlled with the same RPM, the loads applied to the motor 22 in a case where only the pulsator 16 rotates and in a case where the pulsator 16 rotates together with the inner tub 14 may be different from each other. Therefore, the rotation cycles in the cases are different from each other. The controller 10 may determine, on the basis of this difference, if only the pulsator 16 rotates or the pulsator 16 rotates together with the inner tub 14.

FIG. 7 is a flowchart of a washing machine control method according to an exemplary embodiment of the present invention. Referring to FIG. 7, wash water is supplied into the inner and outer tubs 14 and 12 (S10). The controller 10 opens a water supply valve 6 to supply the wash water through the water supply passage 5. When the water level of the outer tub 12 reaches a predetermined level, the controller 10 closes the water supply valve. The wash water is supplied to a space under the buoyancy clutch 40 is supplied and thus the buoyancy clutch 40 moves to the upper position by the buoyancy created by the wash water. As a result, the buoyancy clutch 40 is separated from the second driving shaft 32.

When the supply of the wash water is completed, the controller alternately rotates the motor 22 in both directions (S20). Since the buoyancy clutch 40 is separated from the second driving shaft 32, only the pulsator 16 alternately rotates in the both directions. The laundry is treated by the frictional force between the pulsator 16 and the laundry and the agitating water stream formed by the pulsator 16.

After the above, the controller 10 stops the motor 22 temporarily and operates the pump 26 (S30). As the pump 26 operates, the wash water collected under the buoyancy clutch 40 is drained to the outer tub 12 through the through hole 54*h* of the hub 50 to release the buoyancy acting on the buoyancy clutch 40. Accordingly, the buoyancy clutch 40 moves downward by the gravity and thus the second driving shaft engaging portion 42 is engaged with the second driving shaft 32.

Next, the controller 10 drives continuously the motor in one direction (S40). In Step S30, if the second driving shaft engaging portion 42 is accurately engaged with the second driving shaft 32, the pulsator 16 and the inner tub 14 rotate together with each other after Step S40. If not, only the pulsator 16 will still rotate.

In Step S50, it is determined if the buoyancy clutch 40 accurately operates in Step S30 and thus the driving shaft engaging portion 42 is accurately engaged with the second driving shaft 32. The controller 10, as described above, determines if only the pulsator 16 rotates or the pulsator 16 rotates together with the inner tub 14 in accordance with the detecting value of the driving detecting unit 36.

Here, when it is determined that the pulsator 16 and the inner tub 14 integrally rotate together with each other, it is determined that the buoyancy clutch 40 normally operates in Step S30. When it is determined that only the pulsator 16 rotates, Step S60 is performed as it is case where the buoyancy clutch 40 abnormally operates in Step S30.

When the buoyancy clutch 40 abnormally operates, it can be assumed that the second driving shaft engaging portion 42 is not accurately engaged with the second driving shaft 32 and thus the buoyancy clutch 40 is not accurately lowered.

In Step 60, a process for allowing the second driving shaft engaging portion 42 to be accurately engaged with the second driving shaft 32 is performed. The controller 10 alternately rotates the motor 32 in the both direction. As the buoyancy clutch 40 rotates in the both direction, the second driving shaft engaging portion 42 moves to a correct position relative to the second driving shaft 32 and thus the second driving shaft engaging portion 42 is accurately engaged with the second driving shaft 32.

Then, the process is returned to Step S40 to operate the motor 22 and repeat the Step S50.

Meanwhile, In Steps S40, S50, and the like, the pump may keep operating to maintain the lower position of the buoyancy clutch 40.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The invention claimed is:

1. A washing machine, comprising:

an outer tub holding wash water;

an inner tub rotatably provided in the outer tub and receiving laundry;

a pulsator rotatably provided in the inner tub;

a pair of coaxial driving shafts comprising a first driving shaft coupled to the pulsator and a second driving shaft for rotating with the inner tub;

a buoyancy clutch disposed between the pulsator and the outer tub, the buoyancy clutch configured to rotate with the first driving shaft, and move up and down along the first driving shaft in accordance with buoyancy created by the wash water, wherein the buoyancy clutch is disengaged with the second driving shaft in an upper position, and is engaged with the second driving shaft in a lower position to allow the pulsator to rotate with the inner tub;

a circulation passage allowing the wash water drained out of the outer tub to be returned into the outer tub;

a pump provided on the circulation passage;

a hub supporting the inner tub, the hub disposed between the buoyancy clutch and the outer tub, wherein the hub is provided with an upwardly extending cylindrical barrier for storing the wash water below the buoyancy clutch and a plurality of through holes are formed at the hub in a region surrounded by the barrier; and a passage guide that is disposed between the hub and the outer tub to direct the wash water drained through the through holes formed on the hub to a drain hole of the outer tub, the drain hole being connected to the circulation passage, wherein the cylindrical barrier is disposed below the buoyancy clutch within an area surrounded by the buoyancy clutch when the buoyancy clutch is located at the lower position.

2. The washing machine of claim 1, wherein the passage guide is provided with an opening through which the pair of driving shafts passes and the inner circumference of the opening is spaced apart from the pair of driving shafts so as not to interfere with the pair of driving shafts.

3. The washing machine of claim 2, wherein the passage guide has a passage width that is gradually reduced from the opening to the drain hole formed on the outer tub.

4. The washing machine of claim 1, further comprising:

a rib formed along a circumference of the passage guide.

5. The washing machine of claim 1, further comprising:

a motor rotating the first driving shaft; and a controller that controls the pump such that the pump operates to drain the wash water from the outer tub for lowering the buoyancy clutch and controls the motor such that the motor continuously rotates the first driving shaft in one direction during the operation of the pump.

6. The washing machine of claim 5, wherein the controller controls rotation of the inner tub such that the wash water flows along a space between the inner and outer tub to a level higher than an upper end of the inner tub.

7. The washing machine of claim 5, further comprising:

a driving detecting unit for detecting a driving state of the motor, wherein the controller changes a control of the motor such that the motor alternately rotates the first driving shaft in both directions based on the driving state of the motor which is detected while the motor is controlled to be continuously rotated in one direction.

8. The washing machine of claim 1, wherein the first and second driving shafts are coaxially aligned and have different outer diameters, wherein the buoyancy clutch comprises a floater that moves up and down along the first driving shaft and a second driving shaft engaging portion that engages with the second driving shaft when the floater is in the lower position.

9. A washing machine comprising:

an outer tub holding wash water;

an inner tub rotatably provided in the outer tub and receiving laundry;

a pulsator rotatably provided in the inner tub;

a power transmission shaft rotating the pulsator;

a buoyancy clutch that moves up and down by buoyancy created by the wash water and transfers, when the buoyancy clutch is in a lower position, rotational force from the power transmission shaft to the inner tub to allow the pulsator and the inner tub to rotate with each other;

a circulation passage allowing the wash water drained out of the outer tub to be returned into the outer tub;

a pump provided on the circulation passage;

a drain guide unit that directs the wash water under the buoyancy clutch to a drain hole of the outer tub so that the buoyancy clutch moves downward; and a hub that supports the inner tub and is configured to be rotated with the inner tub, the hub being rotated by the power transmission shaft when the buoyancy clutch is at the lower position, wherein the hub is provided with an upwardly extending cylindrical barrier for storing the wash water below the buoyancy clutch and the through holes are formed at the hub in a region surrounded by the barrier, and wherein the cylindrical barrier is disposed below the buoyancy clutch within an area surrounded by the buoyancy clutch when the buoyancy clutch is located at the lower position.

10. The washing machine of claim 9, wherein the drain guide unit further comprises:

a passage guide that is disposed between the hub and the outer tub to direct the wash water drained through the through holes formed on the hub to the drain hole of the outer tub, the drain hole being connected to the circulation passage.

11. The washing machine of claim 10, wherein the passage guide is provided with an opening and has a passage width that is gradually reduced from the opening to the drain hole formed on the outer tub.

12. The washing machine of claim 10, further comprising a rib formed along a circumference of the passage guide.

13. The washing machine of claim 10, wherein the passage guide has a first end on which an opening through which the power transmission shaft passes is formed and a second end on which a drain pipe connecting portion connected to a drain pipe formed on the outer tub is formed.

* * * * *